United States Patent [19]

Nagai

[11] 4,408,921

[45] Oct. 11, 1983

[54] DETACHABLE HEAD MEMBER HAVING SLIT STRUCTURE

[75] Inventor: Masahiko Nagai, Tokyo, Japan

[73] Assignee: Ogawa Chemical Industries, Ltd., Tokyo, Japan

[21] Appl. No.: 319,316

[22] Filed: Nov. 9, 1981

[30] Foreign Application Priority Data

Nov. 13, 1980 [JP] Japan ..... 55-163186[U]

[51] Int. Cl.[3] ..... B43K 3/00; B43K 8/02

[52] U.S. Cl. ..... 401/198; 401/89; 401/116; 401/199; 401/202; 401/207

[58] Field of Search ..... 401/198, 199, 207, 196, 401/209, 116, 89

[56] References Cited

U.S. PATENT DOCUMENTS

| | | | |
|---|---|---|---|
| 3,003,182 | 10/1961 | Rosenthal | 401/207 |
| 3,355,239 | 11/1967 | Albrecht | 401/198 X |
| 3,399,021 | 8/1968 | Matsumoto | 401/199 |
| 3,972,629 | 8/1976 | Whalen, Jr. | 401/199 |
| 4,209,263 | 6/1980 | Droubay | 401/199 X |
| 4,317,639 | 3/1982 | Kato | 401/199 X |

FOREIGN PATENT DOCUMENTS

| | | | |
|---|---|---|---|
| 2208111 | 9/1973 | Fed. Rep. of Germany | 401/199 |
| 1256344 | 2/1961 | France | 401/209 |
| 1067800 | 5/1967 | United Kingdom | 401/198 |

*Primary Examiner*—Steven A. Bratlie

*Attorney, Agent, or Firm*—Birch, Stewart, Kolasch and Birch

[57] ABSTRACT

A marking pen containing a head seat member which is adapted to be readily engaged with a shaft tube, whereby the tip member of the marking pen can be exchanged and the extrusion length of the top part of the tip member can be adjusted. On the outer surface of an engaging tube of the head seat member is positioned a projection structure abutting against the top portion of the inner surface of the shaft tube, thereby preventing the head seat member from becoming loose under pressure applied from any direction during marking. In the head seat member the engaging tube is provided with one or more axially elongated slits extending substantially to the end thereof so that the engaging tube is adapted to be deformed by means of the slit, the deformation preventing the engaging tube from engaging the shaft tube too tightly, thereby permitting the smooth axial movement of the head seat member and the easy fine adjustment of the extrusion length of the top part of the tip member.

2 Claims, 18 Drawing Figures

DETACHABLE HEAD MEMBER HAVING SLIT STRUCTURE

BACKGROUND AND SUMMARY OF THE INVENTION

The present invention relates to a sign pen among the so-called "marking pens" and is particularly concerned with an improved sign pen which employs a fine pen tip including very fine tips.

The conventional sign pens are divided into two main classes in structure. One of them has a structure in which a tip member 3*a* is supported on a shaft tube 1*a* in a fixed relationship, whereby the projecting length of the top part of the tip member 3*a* cannot be adjusted or said tip member cannot be removed, as shown in FIG. 1. The other, as shown in FIG. 2 through FIG. 5, includes a structure wherein the protrusion length of the top part of the tip members 3*b*, 3*c*, 3*d* and 3*e* respectively can be adjusted.

The former sign pen illustrated in FIG. 1 comprises a structure wherein a tip member 3*a* is inserted through a holding tube 2*a* secured to the top portion of a shaft tube 1*a*. The tip member 3*a* is fixed to the holding tube 2*a* by means of caulking or the like in such a manner that the top part of the tip member 301*a* protrudes a desired length from the tube 2*a*. Thus the tip member 3*a* is supported to the shaft tube 1 through the holding tube 2*a* in a fixed relationship, whereby a base part 302*a* of the tip member 3*a* fixed to the shaft tube 1*a* is connected with an ink reservoir member 4*a* provided within the shaft tube 1*a*. This is a very popular sign pen that has been widely used for a long time. However, this pen exhibits a disadvantage when using a small-diameter tip for fine writing. In such a case, since the writing pressure is substantially constant regardless of the diameter of the tips, the writing load of the tip per unit area will be increased, causing greater friction between the tip and writing surface (writing surface of paper or similar material) thus the tip will be quickly worn away and become shorter and accordingly its use is materially limited. In order to eliminate this disadvantage, it is desired that the protrusion length of the top part of the tip from the supporting tube be adjustable so as to permit writing with the top portion of the tip having a constant protrusion length at all times, or alternatively providing that the tip can be readily exchanged. However, the sign pen as described above has a structure such that the protrusion length adjustment or exchange of tips is not allowed. Accordingly, it has been strongly demanded to provide an improved structure which permits an adjustment in the protrusion length or the exchanging of tips.

The sign pens illustrated in FIG. 2 through FIG. 5 are provided in order to reply to the above-mentioned demand.

The type of sign pen shown in FIG. 2, which has already been placed on the market as Japanese Utility Model No. 36,529/1972, comprises a structure wherein a head seat member 2*b* is threadedly engaged with a shaft tube 1*b* and can be moved axially. However, according to this structure, there are two major problems. First, since a structure to directly contact a tip member 3*b* with an ink reservoir member 4*b* within a shaft tube 1*b* is employed, the tip member 3*b*, as can be seen in the drawing, reaches the ink reservoir 4*b* within the shaft tube 1*b* by means of an axially elongated, axial position adjustable mechanism, i.e., the threaded structure of the shaft tube 1*b* and the head seat member 2, and therefore a very long tip member is required. With such a long tip member, the ink stored in the ink storage member 4*b* must flow along a very long passage which may prevent the smooth flow of ink or give rise to a discontinuity in the ink flow. For this reason, a clear marking cannot always be expected. Secondly, in this structure, to directly contact the base part 302*b* of the tip member 3*b* with the ink storing member 4*b*, since said reserving member is made of a member having a fiber structure like a tobacco filter which has a coarse fiber density and much space, the tip member 3*b* cannot come in contact with the ink reservoir member 4*b* conveniently and the ink reserved in the said reservoir cannot be properly sucked up by the tip member 3*b*, resulting in the prevention of a smooth ink flow and a discontinuity of ink. For this reason, a clear marking cannot be obtained.

The latter type of felt pens shown in FIG. 3, FIG. 4 and FIG. 5 have already been placed on the market as the Japanese Utility Model No. 179,248/1979 by the same applicant as the one mentioned before. With each of the structures illustrated in these three drawings, since tip members 3*c*, 3*d*, 3*e* are fixed and supported to their respective shaft tubes 1*c*, 1*d*, 1*e* respectively, even if head seat members 2*c*, 2*d*, 2*e* are respectively threaded with the shaft tubes 1*c*, 1*d*, 1*e* in such a manner as to be able to travel axially, it is difficult to exchange tip members 3*c*, 3*d*, 3*e* when they are worn out. In other words, the structure shown in FIG. 3 comprises: pressing an inner tube 101*c* having threads into an outer tube 102*c* and fixing it to the said outer tube to form a shaft tube 1*c*, mounting an O-ring 103*c* onto the outer surface front portion of the outer tube 102*c*, inserting the tip member 3*c* through a holding tube 4*c* pressed into and fixed within the inner tube 101*c*, securing the tip member 3*c* by caulking the top part of the holding tube, and said head seat member 2*c* being threadedly engaged with the thread of the inner tube 101*c* and the base portion thereof being placed over the outer tube 102*c* to be brought into contact with the O-ring 103*c*. Accordingly, the tip member 3*c* is, by means of the supporting tube 4*c*, fixedly supported to the shaft tube 1*c* consisting of the inner tube 101*c* and the outer tube 102*c*.

The structure shown in FIG. 4 comprises an inner tube 101*d* having threads therein and pressed into an outer tube 102*d* and fixed thereto to form a shaft tube 1*d*, a tip member 3*d* is inserted through a holding tube 4*d* which has been pressed into the inner tube 101*d* and secured thereto, the tip member 3*d* is fixed by caulking the top part of the holding tube or other similar operation. A head seat member 2*d* is made up of two divided portions, i.e., a forward segment 201*d* and a rearward segment 202*d*, said rearward segment 202*d* being first engaged with the threads of the inner tube 101*d* and the base part thereof being placed over the outer tube 102*d* before said forward segment 201*d* is threadedly engaged with the threads of the inner tube 101*d* and thus brought into contact with said rear segment 201*d*. This is a structure constructed in a so-called double-nut manner or lock-nut manner. Accordingly, the tip member 3*d* is fixedly supported by way of the supporting tube 4*d* on the shaft tube 1*d* consisting of the inner tube 101*d* and the outer tube 102*d*.

The structure illustrated in FIG. 5 comprises an inner tube 101*e* pressed into and fixed to an outer tube 102*e* to form a shaft tube 1*e*. A split groove 103*e* is provided at the top portion of the inner tube 101*e* so that said inner tube may be springy at the top portion thereof. A tip member 3e is extended through a holding tube 4e pressed into and fixed to said inner tube, the tip member being fixedly secured by means of caulking the top part of the holding tube or other similar operation. A head seat member 2e is mounted on the top portion of the inner tube 101e in such a manner that it can slide in an axial direction. Thus, the tip member 3e is, by means of the holding tube 4e, fixedly supported on the shaft tube 1e consisting of the inner tube 101e and the outer tube 103e.

From the description mentioned above, it can be understood that with any of the structures shon in the above-mentioned three figures, it is very difficult to exchange tip members.

The structure illustrated in FIG. 3 has other disadvantages than the above mentioned disadvantages of nonexchangeability of the tip members: firstly, in this structure, direct contact is established between the tip member 3c and the ink storing member (not shown) within the shaft tube, 1c, which, as in the structure shown in FIG. 2, requires a very long tip member 3c. As a result, the flow of ink may be blocked and thus the ink may be caused to discontinue. Secondly, the ink reserving member is made of a member having the same fiber structure as in FIG. 2, and, therefore, the ink stored in the ink reservoir will not be properly drawn up by the tip member 3c. This prevents the ink from flowing smoothly and causes the ink to flow discontinuously. As a result, a clear marking cannot be expected. Thirdly, since an O-ring 103c mounted on the shaft tube 1c is located adjacent to the base part of the head seat member 2c, it is true that the O-ring 103c substantially abuts against the base part of the head seat member 2c, but the top part of the head seat member 2c may have play around the center line about the O-ring 103c which serves as its fulcrum. This play or unstable condition of the top part of the head seat member will not only produce difficulties in writing but also distort the tip member 3c and prevent the smooth flow of the ink. Thus, the present structure lacks the appropriate considerations for preventing the above-mentioned play.

The structure shown in FIG. 4, in addition to the above-mentioned weak point of non-exchangeability of the tip members, has another disadvantage. In this structure is employed a double-nut system or lock-nut system in which a head seat member 2d consists of a forward segment 201d and a rearward segment 202d, both of said segments being threadedly engaged with an inner tube 101d, and, therefore, in order to adjust the length of the top part of a tip member 3d, said member must be turned successively to travel axially. This means that the present structure is difficult to operate and thus is inconvenient in use.

The structure shown in FIG. 5 includes a split groove 103e at the top portion of an inner tube 101e. Since this split groove is provided in such a position as to be loaded by a head seat member 2d, said top portion may produce a deformation phenomenon through secular change, or, the so-called creep phenomenon, which will result in failing to perform not only functions for chucking or retaining the tip member 3e but also the function for preventing the head seat member 2e from having play or being loose.

Fiinally, it should be kept in mind that the structures illustrated in FIG. 3, FIG. 4, and FIG. 5 have the disadvantage that the smooth flow of ink and the proper holding of ink in the respective tip members 3c, 3d, 3e are prevented. Because the tip members 3c, 3d, 3e shown in the three figures are respectively supported by means of caulking of the holding tubes 4c, 4d, 4e, the flow passage of ink will be pressed to become narrower, so that the smooth ink flow will be prevented and the proper retaining of ink cannot be established. Accordingly, clear writing cannot be expected.

Accordingly, the present invention has been devised in order to eliminate the above-mentioned disadvantages present in the prior art, well known sign pens. The present invention is characterized in that the head seat member is adapted to be threadedly engaged with the shaft tube, whereby the tip member can be exchanged and the extrusion length of the top part of the tip member can be adjusted. On the outer surface of the engaging tube of the head seat member is arranged a projection structure abutting against the top portion of the inner surface of the shaft tube thereby preventing the head seat member from becoming loose under pressure applied from any direction during marking. In said head seat member the engaging tube is provided with one or more axially elongated slit(s) extending substantially to the end thereof so that said engaging tube is adapted to be deformed by means of said slit, the deformation preventing said engaging tube from engaging the shaft tube too tightly, thereby permitting the smooth axial movement of the head seat member and the easy fine adjustment of the extrusion length of the tip member top part. Within the shaft tube is fixed an ink guide core communicating with an ink reservoir provided within the shaft tube. The tip member is connected with the said guide core, eliminating the use of a very long tip member for smooth ink flow and thus for clear marking. Furthermore, the marking pressure applied on the tip member is received by said ink guide core in order to prevent deformation or destruction of the top member. In the form of a conical surface is arranged the top portion of a small-diameter central opening adaptable to the diameter of the tip member. Over the front portion of the ink guide core is fixedly positioned a collector of the -type section, in which a large-diameter opening adaptable to the diameter of the ink guide core is provided at the base part side of the central opening opposite said conical surface, whereby said collector prevents the ink guide core from being broken into pieces or being cut apart due to marking pressure or similar cause. As a result, it is easier to collect ink in the front part of the ink guide core, as well as when communicating the tip member with the ink guide core, such communication being readily achieved and correctly by means of the conical surface so that the tip member is prevented from being deformed or being destroyed at the base portion thereof. The ink in the ink guide core is allowed to flow smoothly into the tip member, and said collector prevents the ink stored in the top portion of the ink guide core from evaporating or drying unnecessarily. Through the collector extends the base part of the tip member protruding from the head seat member for communicating with the ink guide core, whereby, without fixing the tip member anywhere, the collector can support the tip member to the degree that the tip member can maintain its immovable state against, the axial movement of the head seat member oscillation or shock in order to prevent the ink flow passage within the tip member from narrowing due to the fixed engagement of the tip member, as well as to permit easy and quick exchange of the tip member.

Accordingly, the main object of the present invention is to provide an improved, high-quality and useful marking pen which can eliminate all of the disadvantages included in the prior arts.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 6(*b*) is a side elevation of FIG. 6(*a*).

FIG. 7(*b*) is a side elevational view of FIG. 7(*a*).

DETAILED DESCRIPTION OF THE INVENTION

Figure 1:
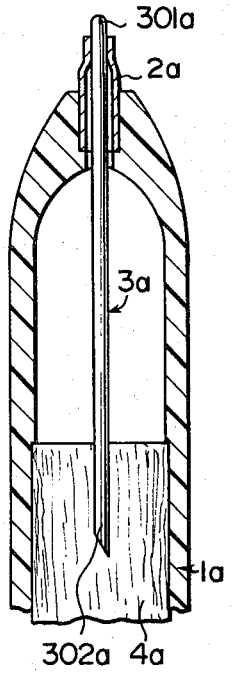
FIG. 1 PRIOR ART
FIG. 1 is an enlarged vertical sectional view showing the main portions of a prior art sign pen in which it is not possible to adjust the extrusion length of the top portion of the tip member and to exchange the tip members when worn out.
Figure 2:
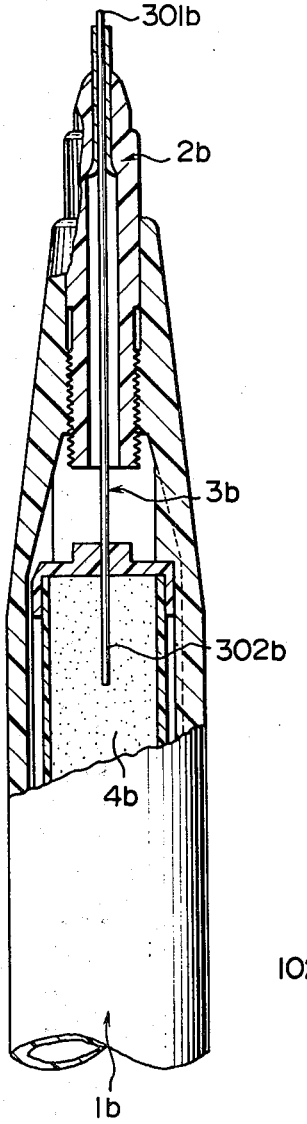
FIG. 2 PRIOR ART
FIG. 2 is an enlarged vertical sectional view showing the main portions of another prior art sign pen in which it is possible to adjust the extrusion length of the top portion of the tip member.
Figure 3:
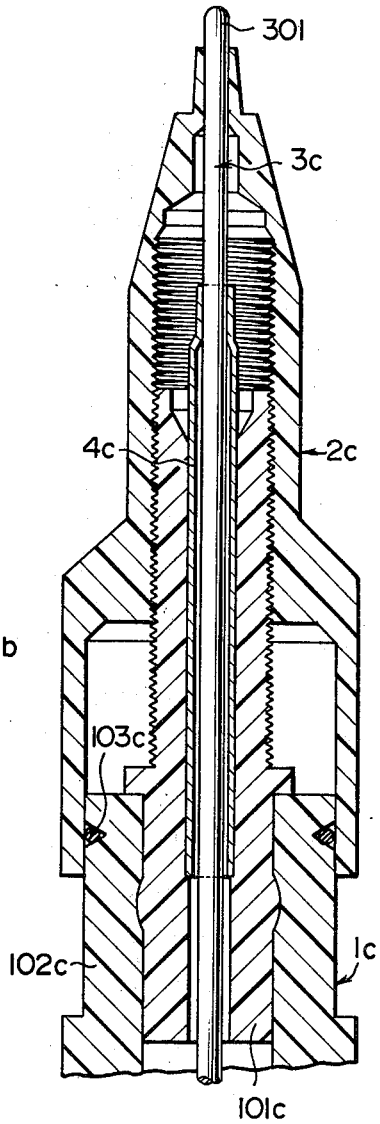
FIG. 3 PRIOR ART
FIG. 3 is an enlarged vertical sectional view showing the main parts of another prior art sign pen in which it is also possible to adjust the extrusion length of the top portion of the tip member.
Figure 4:
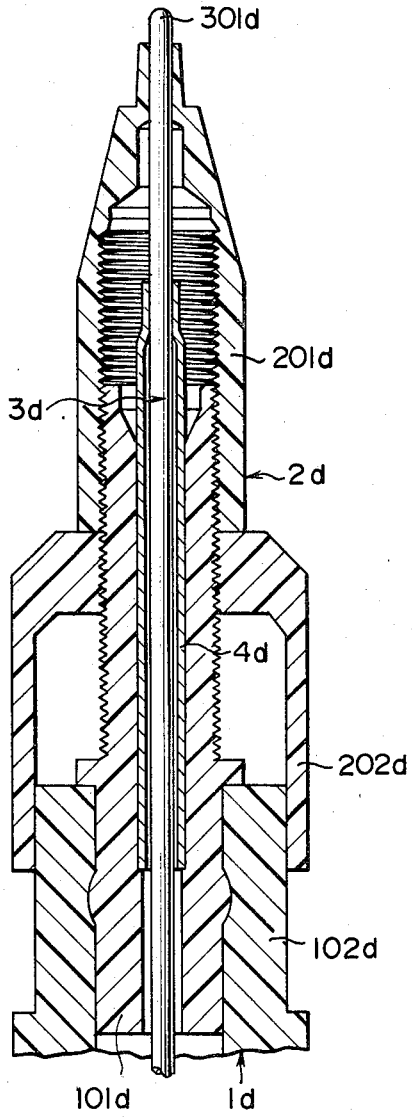
FIG. 4 PRIOR ART
FIG. 4 is an enlarged vertical sectional view showing the main portions of still another prior art pen in which it is also possible to adjust the extrusion length of the top portion of the tip member.
Figure 5:
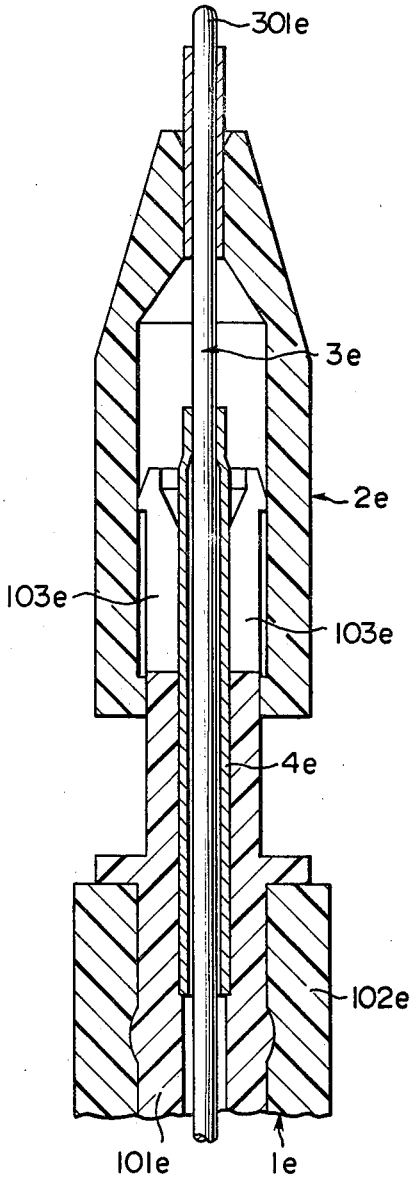
FIG. 5 PRIOR ART
FIG. 5 is an enlarged vertical sectional view showing the main portions of yet another prior art sign pen in which it is possible to adjust the extrusion length of the top portion of the tip member.
Figure 6A:
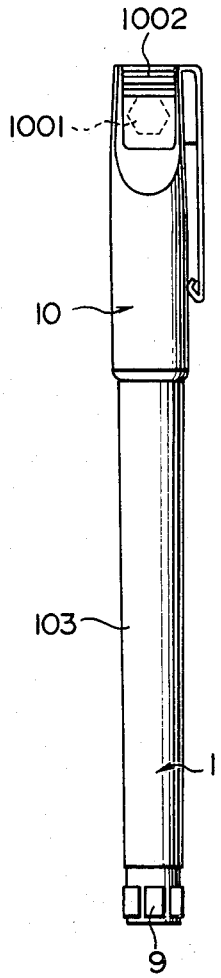
FIG. 6(*a*) is a front view showing an embodiment of the present invention on which is placed a cap.
Figure 6B:
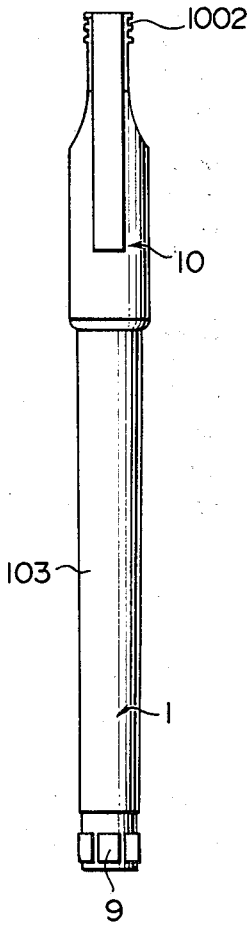
Figure 8:
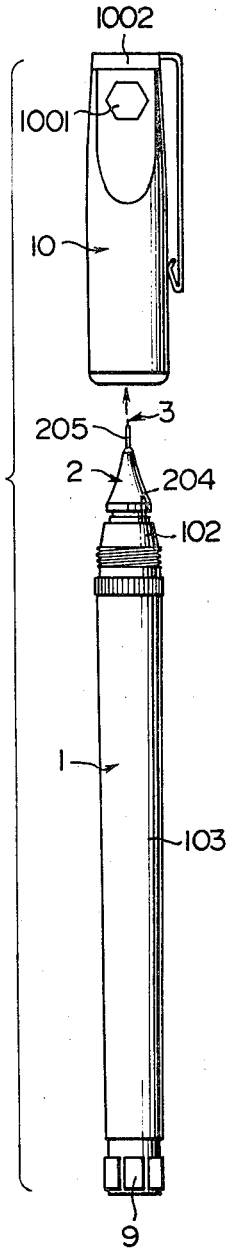
FIG. 8 is a front view showing the state in which the cap in FIG. 7(*a*) has been removed.
Figure 7A:
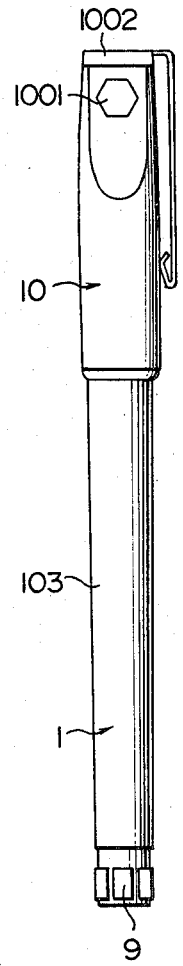
FIG. 7(*a*) is a front view showing another embodiment of a marking pen according to the present invention on which is placed a cap having a different structure from the one illustrated in FIG. 6.
Figure 7B:
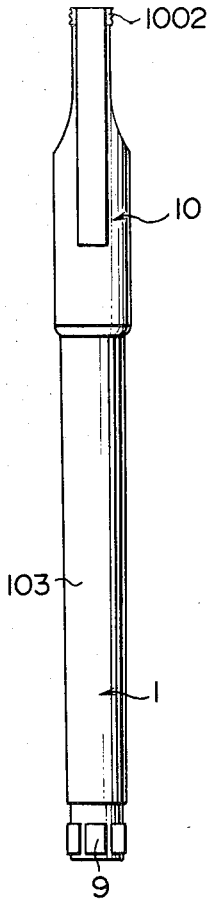
Figure 9:
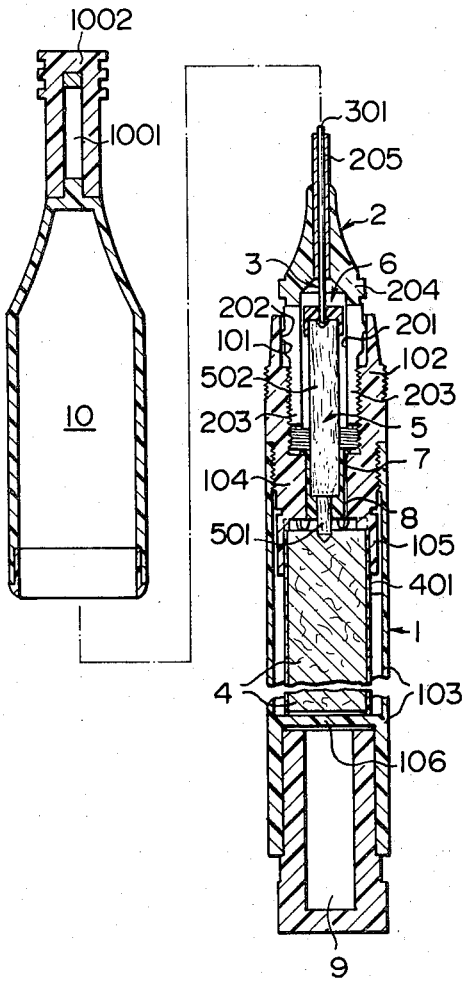
FIG. 9 is a partially broken enlarged vertical view showing the state in which the cap in FIG. 6(*b*) has been removed.
Figure 10:
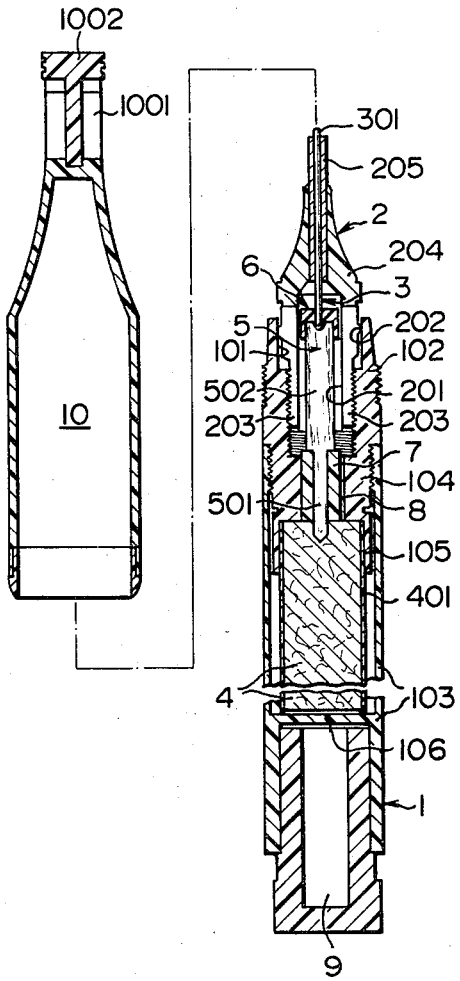
FIG. 10 is a partially broken, enlarged vertical view showing the state in which the cap in FIG. 7(*b*) has been removed.
Figure 15:
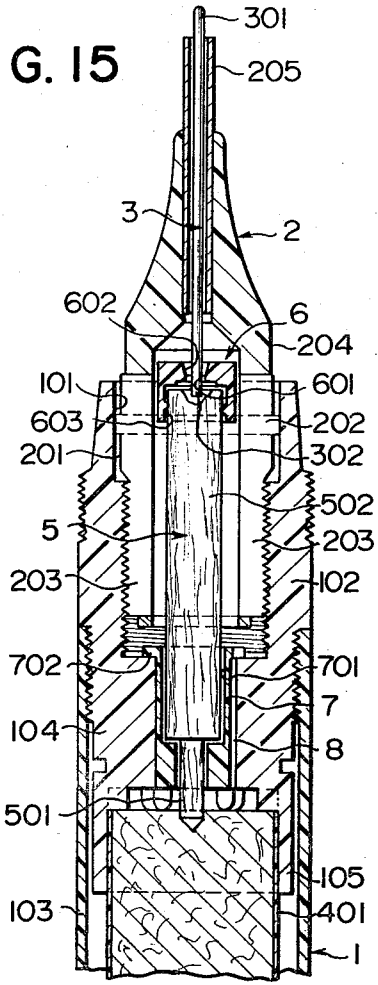
FIG. 15 is an enlarged vertical sectional view of the main portions showing the state in which the extrusion length of the tip member top portion has been increased.
Figure 12:
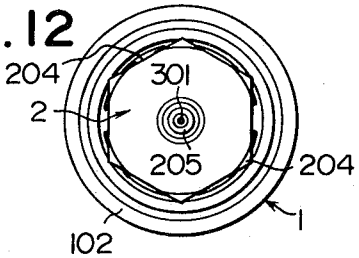
FIG. 12 is a plan view of FIG. 11.
Figure 13:
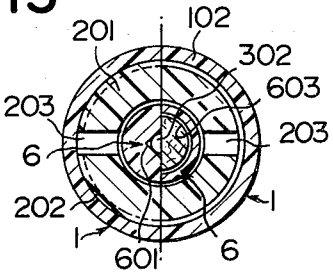
FIG. 13 is a transverse sectional view taken along line (I)—(I) shown in FIG. 11.
Figure 14:
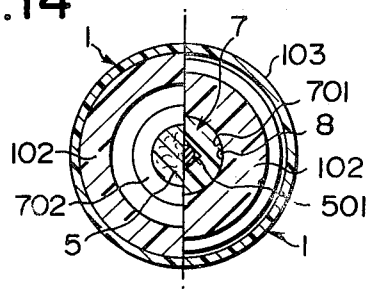
FIG. 14 is a transverse sectional view taken along line (II)—(II) in FIG. 11.
Figure 11:
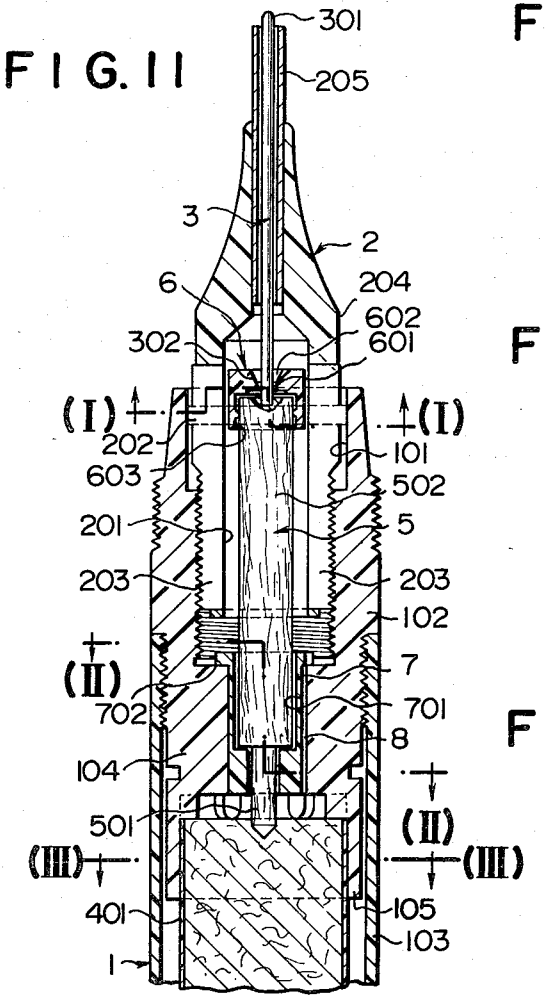
FIG. 11 is an enlarged vertical sectional front view showing the main portions of the sign pen according to the present invention.
Figure 16:
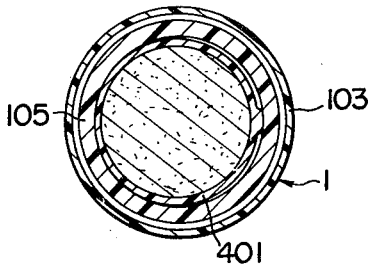
FIG. 16 is a transverse sectional view taken along line (III)—(III) in FIG. 11.

In the drawings, 1 designates a shaft tube, 2 designates a head seat member, 201 designates an engaging tube of the head seat member, 202 designates a projection structure thereof, 203 designates a slit thereof, 3 designates a tip member, 301 designates a top portion thereof, 302 designates a base portion thereof, 4 designates an ink reserving member, 5 designates an ink guide core, 6 designates a collector of ⌐-type section, 601 designates a central opening, 602 designates a conical surface at the top part of the central opening, and 603 designates a large-diameter opening at the narrow portion of the central opening.

The present invention will now be explained by making reference to the drawings. A shaft tube 1 is constructed by threadedly engaging a forward shaft section 102 with a rearward shaft section 103. A partition wall is projected in a centripetal direction in the interior adjacent to the base portion of the forward shaft, and in the forward shaft base portion is extended a cylindrical wall 105 having an inner diameter adapted for the diameter of an ink reserving member 4 in an axial direction, so that said forward shaft 102 is formed as having a substantially H-type section. A ventilator tube 7 is removably inserted at the center of said partition wall 104. An ink guide core 5 extends through the center of said ventilator so that the ink guide core communicates with the ink reservation member 4, and at the same time, in the outer surface of the ventilator tube 7 is provided a concave groove 701 axially extending therethrough so that said ventilator tube 7 is removably inserted at the center of the partition wall 104, whereby a ventilation passage 8 is formed by means of said concave groove 701 and said partition wall 104. Accordingly, the air within the rearward shaft 103 is sequentially discharged through the ventilation passage 8, the forward shaft section 102, the engaging tube 201 of the head seat member 2, and then a slit 203 provided in said engaging tube 201, while the open air is directed vice versa, so that the air within the rearward shaft 103 can be exchanged and thus the ink is prevented from flowing excessively because of the air expansion within said rearward shaft 103. At the end of said rear shaft 103 a case 9 for spare parts which can be removed, is provided, i.e., for storing tip members for exchange purposes.

In order to achieve threaded engagement with the forward shaft 102, the head seat member 2 is extended with a head seat engagement tube 201 in which are provided one or more axially elongated slits 203 substantially to the end thereof. When threadedly engaged with the forward shaft 102, the engagement tube 201 is caused to deform by means of the slits 203. Even if the engagement tube and the forward shaft 102 are engaged rather tightly, such deformation of the engagement tube 201 with the aid of the slits 203 can loosen the tight engagement somehow to obtain a proper engagement. When the head seat member 2 is engaged with the forward shaft 102 and is rotated, it moves axially. This axial movement of the head seat member must be a smooth movement. In order to obtain such smooth axial movement, it is necessary that a proper degree of engagement be achieved between the forward shaft 102 and the engaging tube 201. With further detailed reference to the structure in which this proper degree of engagement can be obtained, the full diameter of the threaded (the diameter between threads) provided in the outer circumferential surface of the engagement tube 201 is defined to be slightly larger than the root diameter of the thread formed in the inner circumferential surface of said forward shaft, and the forward shaft 102 is pressed against the engagement tube 201 threadedly engaged therewith at the circumference thereof, whereby said engagement tube 201 is slightly deformed in a centripetal direction by means of the slits 203, so that a slight loosening effect can be produced in the degree of engagement in the threaded contact portions of these two components. Accordingly, when such a proper relationship of threaded diameters as mentioned above between the forward shaft 102 and the engagement tube 201 is established, and a proper number of slits are provided in the engagement tube, even if the forward shaft 102 and the mating engagement tube 201 are constructed with slight errors in size to produce a tight engagement, their actual engagement will be slightly looser to provide a proper degree of engagement, so that the head seat member 2 can be smoothly moved in an axial direction and also the threadedly engaged portions will be prevented from being loose.

In the outer surface of the engaging tube 201 of the head seat member 2 is arranged a projecting structure 202 comprising an annular projecting area or a plurality of, e.g., three or so projections (not shown). This structure is positioned in a location to correspond to the inner surface top portion 101 of the forward tube 102 where no thread is provided, the size of projection of the projection structure 202 in the circumferential direction being defined so that the end face of said structure can contact the inner surface top portion 101 of the forward shaft 102, and, thus, said projection structure 202 is brought into contact with the inner surface top portion 101 of the forward shaft 102, whereby the head seat member 2 is prevented from being made loose by pressure applied to the tip member top portion 301 during marking.

The head seat member 2 is further provided with an operation edge 204 for effecting the turning operation. This operating edge is located in such a position as will never be included in the forward shaft 102 even when the head seat member 2 enters said forward shaft to a maximum extent. The operation edge is preferably constructed in such a form as will assure an easy and positive turning operation by the operator's fingers or any suitable tools. Thus, if it is of a regular circle, it should be suitably provided with notches on the circumferential surface thereof, although any shape other than a regular circle will be all right for this purpose, through an embodiment of a plane hexagon is illustrated in the drawing. In the head seat member 2 is fixedly projected a fine tube 205 which extends through the tip member 3, thereby preventing the tip member 3 from buckling. The tip member 3, which is very fine, has a diameter of less than 1 mm and is constructed as a molding made of synthetic resins. The tip member is provided with one or more ink passages only in the interior or in both of the interior and the outer circumferential surfaces thereof, which are not shown in the drawings. When the tip member is brought into contact with or is connected with the ink guide core 5 through a shallow spigot or similar means, the ink impregnated in the ink guide core can flow toward the top end of the tip member. The top end of the tip member is finished in the form of a drill or a shell suitable for fine writing. The ink reservoir member 4, which is provided in the rearward shaft 103, may be a bar member of fibers inpregnated with ink, like a tobacco filter, or may be an ink tube containing raw liquid ink therein. In the drawing, a fibrous bar member is shown. When using such bar members, only the circumferential surfaces thereof are covered with a sheath 401 such as a synthetic resin film, cellophane paper and similar means in order to prevent said fibrous bar member from becoming loose thereby eliminating a cause which may prevent the smooth flow of ink. The top part of said ink storing member 4 is removably inserted into the cylindrical wall 105 provided in the forward shaft 102, while the base part of said ink storage member 4 will not come in contact with any portion of the rearward shaft 103 so that the open air subsequently flowing into the rearward shaft will be able to flow into the ink reservoir member 4 in an amount equal to the amount of ink consumed. Alternatively, the base part of the ink reservoir member 4 may be contacted with the interior surface of a bottom plate 106. This structure is arranged in such a manner that a cross-type convex strip (not shown) is provided on the inner surface of said bottom plate and the base part end face of the ink storage member 4 is brought into contact with this convex strip to produce a slight clearance between the inner face of the bottom plate 106 by means of said cross convex strip, thereby enabling the air contained in the rear shaft 103 to flow into the ink reservoir member 4 in an amount equal to the amount of ink consumed.

The ink guide core 5 is constructed in the form of a bar member provided with a small-diameter rod 501 at the end thereof. When it is made of fiber materials which have been produced by having tow-like or silver-like fibers suitably hardened with synthetic resins, it should be hardened to such a degree as to prevent the tip member 3 from creeping in it under pressure applied during writing. At the same time, the fiber density of said ink guide core 5 must be substantially higher than that of the ink reservoir member 4, so that such creeping action of the tip member 3 under pressure applied when marking, can be prevented as well as enabling the ink impregnated in the ink storing member 4 to run smoothly into said ink guide core 5. The ink guide core 5 may be arranged in the form of a molding consisting of a bar member of synthetic resins. When using this form, said core is manufactured in the following manner. in the interior of the core is provided axial ink passages, said passages being focused toward the center at the top portion thereof, the base portion 302 of the tip member 3 being inserted into said top portion, said tip member base portion being supported by a suitable means to prevent the tip member 3 from creeping into an ink guide core 5 under the marking load applied during the marking. The base portion 302 thus communicates with the ink passages. The base portion of said ink guide core 5 is of a small diameter and is provided with a small-diameter rod 501 which is extended through a ventilating tube 7 mounted at the center of the partition wall 104 in the forward shaft 102, the end of said rod 501 being inserted into the top portion of the ink storge reservoir 4 to a suitable degree in depth. The end face of a body portion 502 between said body portion and said rod 501 is engaged with the ventilating tube 7 and fixed thereto. The top portion of the guide core 5 is covered with a collector 6 in order to prevent said core from being broken into pieces for some reason and also to prevent said core from becoming cracked in any portions thereof, which, as a result, makes it easier to collct ink at the top portion of the ink guide core 5 and enables the ink to move smoothly to the tip member 3.

The collector 6 serves to drill through a central opening 601 adaptable to the diameter of the tip member 3 or a central opening 601 having a different shape from the sectional shape of the tip member 3, and to provide a conical shape 602 at the top portion of said central opening. The collector further provides a large-diameter opening 603 at the base part side of said central opening 601 opposite said conical surface, said large-diameter opening being arrange to have a diameter suitable for receiving the body portion 502 of the ink guide core 5 and also having a ⌐-type section, said large opening being placed over and fixed to the top portion of the ink guide core 5. Through said collector 6 positioned over the top portion of the ink guide core 5 is extended the tip member 3, the base portion 302 of which is abutted against the end face of the top portion of the ink guide core 5 or is connected therewith by means of being inserted into said guide core top portion to a suitable extent in depth. Accordingly, said tip member 3 does not have sufficient strength to stand the writing pressure applied during marking because the base portion thereof is supported by the collector 6 only with a slight force and is not fixed to any location. In other words, the collector 6 is adapted to support the tip member 3 in such a manner that, even if the head seat member 2 is moved in an axial direction, said tip member 3 is prevented from moving together with said head seat member or from being pulled out, and that said tip member 3 will not be pulled out due to oscillation or shock. Therefore, when a marking pressure is applied to the tip member 3, the base portion 302 of the tip member 3 will contact the top portion of the ink guide core 5 much higher to cause a very smooth flow of the ink impregnated in said guide core. The conical surface 602 of the collector 6 enables one to insert the base portion 302 of the tip member 3 through the central opening 601 quickly when the tip member is connected with the ink guide core 5 and eliminates the problems related to the deformation or destruction of the base portion 302 of the tip member 3 as well as the ink flow blocking phenomenon caused by such destruction or deformation, and enables the base portion 302 of the tip member 3 to be connected with the ink guide core 5 in a quick and correct manner. Placement and fixation of the collector 6 over the top portion of the ink guide core 5 prevents ink from drying at said top portion and also prevents said top portion from being loosened into pieces or becoming cracked in some places thereof due to writing pressure or other possible causes, which makes it possible for the ink to be concentrated upon the top portion of the ink guide core 5, resulting in a smooth flow of ink toward the tip member 3.

The ventilation tube 7, which is positioned at the center of the partition wall 104 formed in the forward shaft 102 constituting the shaft tube 1, is provided with a concave groove 701 on the outer or inner circumferential surface thereof, and is also extended with an annular flange 702 engaging the end face of the partition wall 104 at the side of the ink guide core 5. The cap 10 placed over the shaft tube 1 is provided with an operation bore 1001 to which is adapted an operation edge 204 of the head seat member 2. This means that the cap can also be used as a tool for the turning operation. Further, in said operation bore 1001 of the cap 9 is removably mounted an accessory piece 1002 having T-type or ⌐-type section.

The present invention, as described hereinbefore, discloses a marking pen in which the head seat member is projected into and threadedly engaged with the top portion of the shaft tube in such a manner as to move in an axial direction, and the tip member is removably extended through and mounted to said head seat member, whereby the projection length of the tip member top portion from the head seat member can be adjusted, as required. According to the structure of the present invention, the outer circumferential surface of the engagement tube of the head seat member is formed with a projection structure which abuts against the top portion of the inner face of the shaft tube, said engagement tube being provided with one or more axially elongated slits nearly to the end thereof, said engagement tube being deformable by mens of said slits when said tube is engaged with the shaft tube. Within the shaft tube is fixed the ink guide core communicating with the ink reservoir member provided in said shaft tube, the top portion of the ink guide core provided with a small-diameter central opening and being formed as a conically inclined surface, the collector of ⌐-type section, including a large-diameter opening suitable for the diameter of the ink guide core at the base portion of said central opening opposite said conical surface, is positioned over and fixed to the top portion of the ink guide core, and said base portion of said tip member projects from the head seat member and extends through said collector to be connected with the ink guide core. Accordingly, the free exchange of the tip members is achieved and also the extrusion length of the tip member top portion from the head seat member can be conveniently adjusted. Particularly, the arrangement of the projection structure at the outer surface of the head seat engagement tube coming in contact with the top portion of the inner face of the shaft tube assures the effect of preventing the head seat member from wiggling against pressures applied thereto from every direction during marking. Also, the presence of one or more axially elongated slits in the head seat member engaging tube extending substantially to the end thereof enables the same engaging tube to be deformed, which can prevent the degree of its engagement with the shaft tube from being too tight, and thus assure a smooth axial movement of the head seat member and an easy fine adjustment of the projection length of the tip member top portion. Within the shaft tube is fixed the ink guide core which communicates with the ink reservoir member in said shaft tube, and the tip member is connected with said guide core, eliminating the use of a very long tip member. Thus the ink is ensured to flow smoothly for a clear marking, and also, by the manner in which the pressure applied to the tip member by said ink guide core is received, the tip member is prevented from deforming or being destroyed which assures a smooth ink flow in the tip member. An inclined surface is arranged in the top part, in the form of a cone, with the small-diameter of the cone being provided with a central opening adaptable to the diameter of the tip member. Over the top portion of the ink guide core is fixedly placed the collector of ⌐-type section which is provided with a large-diameter opening suitable for receiving the ink guide core at the base portion side of the central opening, opposite said conical surface, whereby said collector prevents the ink guide core from being broken into pieces or being cracked in some places thereof due to marking loads or other possible causes. The collector thus makes it easier to concentrate the ink onto the top portion of the ink guide core, and, when the tip member is connected with the ink guide core, a quick and correct connection is achieved by means of the conical surface which prevents the top part of the tip member from deforming or being destroyed, so that the ink can smoothly flow out of the ink guide core toward the tip member. Furthermore, said collector can prevent the ink contained in said ink guide core from evaporating or drying excessively. The base portion of the tip member projecting from the head seat member extends through the collector to communicate with the ink guide core, so that, without fixing the tip member anywhere, the tip member can be supported by the collector to the extent that said tip member can maintain its immovable state against the axial movement of the head seat member, against oscillation, or against shock, thereby preventing the narrowing deformation of the ink flow passage within the tip member which will be caused by the fixation of said tip member, and also assuring an easy and quick exchange of the tip members. Accordingly, it is understood that the present invention provides an improved useful marking pen which can eliminate all of the disadvantages found in the prior marking pens mentioned above, and that the present invention has accomplished its expected objects.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A marking pen including a head seat member extending from the top portion of a shaft tube and threadedly engaged therewith in an axially movable manner, and a tip member extending through said head seat member and removably mounted thereto, permitting the length of the top portion of said tip member projecting from said head seat member to be adjusted which comprises:

a projecting structure adapted to come in contact with the top portion of the inner surface of said shaft tube, said structure being provided in the outer circumferential surface of the engaging tube of said head seat member, at least one axially elongated slit means provided in the said engaging tube of said head seat member and extending substantially to the end thereof, said engaging tube being engaged with said shaft tube and being deformable because of said slit means, an ink guide core fixed within said shaft tube and communicating with an ink reservoir member disposed in said shaft tube, the top portion of said ink guide core being provided with a small-diameter central opening which is adaptable to the diameter of said tip member, said opening having a conical, inclined surface, and a collector having an aperture adapted to accommodate the diameter of said ink guide core at the base part side of said central opening opposite said conical surface, said collector being positioned over and fixed to the top portion of said ink guide core, the base portion of said tip member projecting from said head seat member extending through said collector for connection with said ink guide core.

2. The marking pen of claim 1 wherein the collector is a ⌐-type section.

* * * * *